US005583464A

United States Patent [19]

Knight, Jr. et al.

[11] Patent Number: 5,583,464

[45] Date of Patent: Dec. 10, 1996

[54] RESISTOR CIRCUIT FOR INTEGRATED CIRCUIT CHIP USING INSULATED FIELD EFFECT TRANSISTORS

[75] Inventors: Thomas F. Knight, Jr., Belmont; William K. Stewart, Lexington; Edward C. Parish, North Reading; Jon P. Wade, Wellesley, all of Mass.

[73] Assignee: Thinking Machines Corporation, Bedford, Mass.

[21] Appl. No.: 242,504

[22] Filed: May 13, 1994

[51] Int. Cl.[6] ..... G05F 1/10

[52] U.S. Cl. ..... 327/538; 327/543; 327/308

[58] Field of Search ..... 327/524, 538, 327/540, 541, 543, 545, 546, 308; 323/315

[56] References Cited

U.S. PATENT DOCUMENTS

| | | | |
|---|---|---|---|
| 4,039,981 | 8/1977 | Ohshi et al. | 327/524 |
| 4,137,466 | 1/1979 | Schemmel et al. | 327/524 |
| 4,471,236 | 9/1984 | Patterson, III | 327/540 |
| 4,864,162 | 9/1989 | Maoz | 327/524 |
| 5,038,035 | 8/1991 | Djenguerian et al. | 327/540 |
| 5,059,890 | 10/1991 | Yoshikawa et al. | 327/541 |
| 5,157,322 | 10/1992 | Llewellyn | 327/541 |
| 5,160,856 | 11/1992 | Yamaguchi et al. | 327/541 |
| 5,164,614 | 11/1992 | Maekawa | 327/541 |

OTHER PUBLICATIONS

Sedra & Smith, Microelectronic Circuits Saunders College Publishing, Philadelphia 1991.

*Primary Examiner*—Timothy P. Callahan
*Assistant Examiner*—Jeffrey Zweizig
*Attorney, Agent, or Firm*—Richard A. Jordan

[57] ABSTRACT

A resistor circuit includes a resistance control circuit and at least one insulated gate field effect transistor. The resistance control circuit includes a control signal output element including a reference transistor for generating a resistance control signal in response to an internal control signal to maintain the reference transistor at a selected resistance value and a resistance value control element including a reference resistor for generating a circuit control signal for controlling the resistance value of the reference transistor in relation to the resistance value provided by the reference resistor. The field effect transistor is controlled by the resistance control signal to provide a resistance value which is a function of the resistance value of the reference transistor (and therefore of the reference resistor) and ratios of selected physical characteristics of the reference transistor.

5 Claims, 4 Drawing Sheets

RESISTOR CIRCUIT 10

RESISTOR CIRCUIT FOR INTEGRATED CIRCUIT CHIP USING INSULATED FIELD EFFECT TRANSISTORS

FIELD OF THE INVENTION

The invention relates generally to the field of electronic circuitry, and more specifically provides a resistor circuit that can be implemented on an integrated circuit chip that provides resistive circuit elements which provide predetermined resistance values.

BACKGROUND OF THE INVENTION

The resistance value provided by a resistor is a function of the resistivity of the material of which it is made and its geometry, in particular its cross-sectional area and its length; if the material's resistivity is considered to be a fixed value, the resistance value provided by a resistor is directly proportional to its length and inversely proportional to its cross-sectional area.

Providing resistors on integrated circuit chips which have predetermined fixed resistance values can be fairly difficult, as manufacturing process variations makes it difficult to ensure that resistors will have precise geometries, and in any event the resistivity of the material from which the resistors are made generally varies with the operational temperatures over which the chip may be used. While it is difficult to provide resistors on an integrated circuit chip which have predetermined values, it should be noted that resistance values of resistors on an integrated circuit chip will vary generally proportionally, so that, while absolute resistance values of resistors may vary, ratios of resistance values will generally remain constant. Accordingly, most of the circuits on an integrated circuit chip are designed to avoid the necessity of having resistors with particular resistance values, but instead circuits are designed so as to use ratios of resistance values.

However, in some circuitry on a chip, ratios of resistance values generally will not suffice. This is particularly the case in circuitry used in input/output circuitry, that is, circuitry used to receive signals from, or transmit signals to, circuitry external to the chip. Generally, such input/output circuit is expected to accommodate certain signalling protocols, in particular to accommodate certain voltage levels and to provide predetermined impedance values. This generally requires providing resistors having selected absolute resistance values.

SUMMARY OF THE INVENTION

The invention provides a new and improved resistor circuit for use on an integrated circuit chip that can provide resistors having highly accurate absolute resistance values.

In brief summary, the resistor circuit includes a resistance control circuit and at least one insulated gate field effect transistor. The resistance control circuit includes a control signal output element including a reference transistor for generating a resistance control signal in response to an internal control signal to maintain the reference transistor at a selected resistance value and a resistance value control element including a reference resistor for generating a circuit control signal for controlling the resistance value of the reference transistor in relation to the resistance value provided by the reference resistor. The field effect transistor is controlled by the resistance control signal to provide a resistance value which is a function of the resistance value of the reference transistor (and therefore of the reference resistor) and ratios of selected physical characteristics of the reference transistor.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
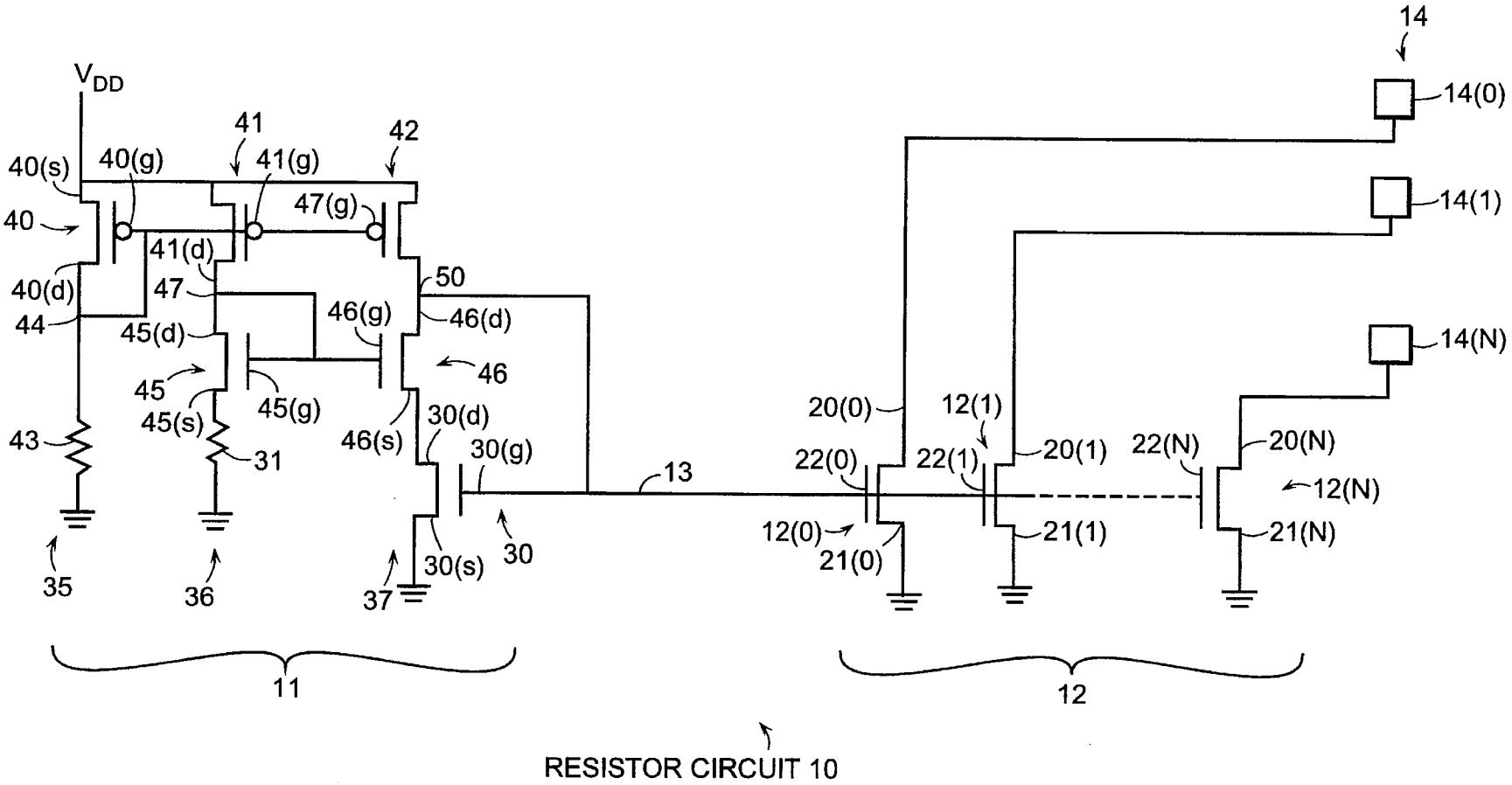
FIG. 1 is a schematic circuit diagram of a resistor circuit constructed in accordance with the invention.

FIG. 1 is a schematic circuit diagram of a resistor circuit 10 constructed in accordance with the invention. With reference to FIG. 1, the resistor circuit 10 includes a resistance control circuit 11 which controls a set 12 of resistor elements 12(0) through 12(N) [generally identified by reference numeral 12(*i*)] over a line 13. In one particular embodiment, the resistor circuit 10 is used in an input/output portion of an integrated circuit chip, and resistor elements 12 are used as termination resistors in the input/output circuit. Accordingly, each resistor element 12(*i*) is connected to a corresponding input/output pad 14(0) through 14(N) [generally identified by reference numeral 14(*i*)] in input/output circuit 14. Also connected to each pad 14(*i*) is a lead wire and driver and receiver circuitry (not shown), with the driver circuitry coupling signals from other circuitry on the chip to the pad for transmission by the lead wire to other circuitry external to the chip, and receiver circuitry coupling signals provided by the lead wire from other circuitry external to the chip to other circuitry on the chip.

The resistor elements 12(*i*) are in the form of insulated gate field-effect transistors, and in one particular embodiment are in the form of n-channel MOSFETs (metal-oxide-semiconductor field-effect transistors). A MOSFET exhibits a channel resistance between its drain terminal 20(*i*) and its source terminal 21(*i*) which is generally a function of the difference between the voltage on its gate terminal 22(*i*), as applied by the signal on line 13, and the voltage on its source terminal 21(*i*). Over at least a portion of its drain-to-source voltage range, the resistance is generally a constant value, so that changing the drain-to-source voltage difference will result in a corresponding change in the level of current through the channel between the drain terminal and the source terminal. That portion of the drain-to-source voltage range is said to be the transistor's "linear" region, since the current is a generally linear function of the drain-to-source voltage. However, above a certain drain-to-source voltage level a MOSFET will begin to go into "saturation," in which the current is generally a constant value which depends not on the drain-to-source voltage difference, but instead only on the gate-to-source voltage difference, in which case the resistance is no longer a constant value.

The resistance control circuit 11 controls the voltage level on line 13 so that the resistor elements 12(*i*) provide selected resistance values which are a function of the ratios of certain of their geometrical features to corresponding features of an n-channel MOSFET transistor 30, and also a function of the resistance value of a resistor 31, which is an off-chip resistor connected in the resistance control circuit 11. It will be appreciated that, since the resistor 31 is an off-chip resistor, its resistance value is not subject to variation as a function of manufacturing process variations for the chip, and any variation is instead generally a function of operating temperature and life, which can be readily measured and compensated for if necessary.

The resistance control circuit 11 in particular controls the voltage level on line 13 so that the resistance value provided by transistor 30 between its drain terminal 30(*d*) and its source terminal 30(*s*) corresponds to the resistance value of resistor 31. The resistance control circuit 11 includes three legs connected between a power supply, identified as $V_{DD}$, and ground, including a current control leg 35, a resistance value control leg 36 and a control signal output leg 37. Each leg 35, 36 and 37 includes a p-channel MOSFET 40, 41 and 42, all of which have identical characteristics, which operate as matched current sources to provide equal currents to their respective legs 35, 36 and 37. The current level provided by the transistors 40, 41 and 42, is determined by the current control leg 35, and in particular by an off-chip resistor 43, which is connected in series with transistor 40 between the power supply and ground. With reference to transistor 40, since its gate terminal 40(*g*) is connected to its drain terminal 40 (*d*) at a node 44, it will be in saturation. When a transitor is in saturation, current therethrough is generally at a constant level, which depends on the voltage difference between its gate terminal and its source terminal, but is otherwise insensitive to voltage differences between its drain terminal and its source terminal. The gate-to-source voltage level, in turn, will depend on the voltage drop across a resistor 43, which is connected between node 44 and ground, and it will be appreciated that the voltage drop thereacross will depend on its resistance value and the current therethrough, which corresponds to the level of the drain-to-source current through the transistor 40. Since the transistors 41 and 42 are constructed to be similar to the transistor 40, and since node 44 controls the gate terminals 41(*g*) and 42(*g*) of these transistors, they will have the same source-to-drain characteristics as transistor 40, provided the remaining circuit elements in their respective legs 36 and 37 ensure that they are in saturation. In particular, since the gate terminals 40(*g*), 41(*g*) and 42(*g*) of transistors 40, 41 and 42, respectively, are all controlled by node 44, all of the transistors have the same gate-to-source voltage difference. Since all transistors 40 through 42 are in saturation, all will have the same source-to-drain current level.

The resistance value control leg 36 includes, in addition to transistor 41, a transistor 45 and the resistor 31 all connected so that the channels of transistors 41 and 45 and resistor 31 are in series between the power supply $V_{DD}$ and ground. In addition, the control signal output leg 37 includes, in addition to transistor 42, a transistor 46 and the transistor 30, all of whose channels are connected in series between the power supply $V_{DD}$ and ground. The transistors 45 and 46 are similarly-constructed n-channel MOSFET devices. The gate terminals 45(*g*) and 46(*g*) of both transistors 45 and 46 are controlled by a node 47, which forms the point of connection between drain terminals 4 l(*d*) and 45(*d*) of the transistors 41 and 45, respectively. The fixed current sourced through transistor 41 flows through the transistor 45, in particular through the channel between its drain and source terminals 45(*d*) and 45(*s*), and also through resistor 31, effectively providing node 47 with a particular voltage level reflective of the threshold voltage of transistor 45 and the resistance value of resistor 31, and reflecting further the current level. It will be appreciated that, since node 47 is connected to both the drain terminal 45(*d*) and the gate terminal 45(*g*) of transistor 45, the transistor 45 is in saturation.

Since the node 47 also controls the voltage level applied to gate terminal 46(*g*) of transistor 46, and the transistor 46 is identical to transistor 45, transistor 46 will also be in saturation, provided certain characteristics of transistor 30, as noted below, are selected to ensure that transistor 46 will stay in saturation. Assuming that transistor 46 is in saturation, since the gate terminals 45(*g*) and 46(*g*) of transistors 45 and 46, respectively, are controlled by the voltage level of node 47, and since the currents through both transistors 45 and 46 are controlled by transistors 41 and 42 to be the same, the voltage difference between gate terminal 46(*g*) and source terminal 46(*s*) of transistor 46 is the same as the voltage difference between the gate terminal 45(*g*) and source terminal 45(*s*) of transistor 45. As a result, both transistors 45 and 46 have the same voltage level, relative to ground, at their source terminals 45(*s*) and 46(*s*), respectively. Since the voltage level of source terminals 45(*s*) and 46(*s*), respectively, relative to ground corresponds to the voltage difference across the resistor 31 and between the drain terminal 30(*d*) and source terminal 30(*s*) of transistor 30, respectively, and since the currents through resistor 31 and transistor 30 are controlled by transistors 41 and 42 to have the same value, transistor 46 will control node 50 to, in turn, control transistor 30 to have a channel resistance that corresponds to the resistance value of resistor 31. As noted above, this correspondence in resistance values will hold provided (i) that the circuit is constructed so that transistors 41 and 42 are, like transistor 40, in saturation while the resistor circuit 10 is in operation, and (ii) that the range of voltages that transistor 46 is required to provide at its drain terminal 46(*d*), which corresponds to node 50, in order to maintain the correspondence in resistance values will not take the transistor 46 out of saturation.

That the node 50 will maintain the channel resistance of transistor 30 equal to the resistance value of resistor 31 will be appreciated from the following examples. If the channel resistance of transistor 30 were to deviate upwardly, since transistor 42 provides a constant current though control signal output leg 37, the voltage level at source terminal 46(*s*) would increase. Since the voltage level applied to gate terminal 46(*g*) is held constant by node 47, the voltage difference between gate terminal 46(*g*) and source terminal 46(*s*) will decrease, so that the transistor 46 will attempt to conduct less current between its drain and source terminals 46(*d*) and 46(*s*), respectively. As a result, the voltage level at the drain terminal 42(*d*), and hence of node 50, will increase, which in turn increases the voltage level of gate terminal 30(*g*) of transistor 30. The increase in voltage level of gate terminal 30(*g*), in turn, tends to reduce the channel resistance of transistor 30, effectively counteracting the upward deviation.

Contrariwise, if the channel resistance of transistor 30 were to deviate downwardly, since transistor 42 provides a constant current through control signal output leg 37, the voltage level at source terminal 46(*s*) would decrease. Since the voltage level applied to gate terminal 46(*g*) is held constant by node 47, the voltage difference between gate terminal 46(*g*) and source terminal 46(*s*) will increase, so that the transistor 46 will attempt to conduct more current between its drain and source terminals 46(*d*) and 46(*s*), respectively. As a result, the voltage level at the drain terminal 42(*d*), and hence of node 50, will decrease, which in turn decreases the voltage level of gate terminal 30(*g*) of transistor 30. The decrease in voltage level of gate terminal 30 (*g*), in turn, tends to increase the channel resistance of transistor 30, effectively counteracting the downward deviation.

As noted above, the voltage level on line 13 controls the resistance levels provided by transistors 12(*i*). Transistors 12(*i*) and transistor 30 are constructed so that selected characteristics are similar, including channel resistivities and lengths between respective drain terminals and source terminals, in which case the resistance provided by each transistor 12(*i*) is proportional to the resistance provided by transistor 30 and inversely proportional to the ratio of the cross-sectional areas of transistor 12(*i*) and transistor 30, or where "R" is the resistance value of the channel of the respective transistor, and "A" is the cross-sectional area. If, as will likely be the case, transistors 12(*i*) and transistor 30 will be formed on the integrated circuit chip during the same processing steps, the depths of the transistors will be the same, and so the proportionality may be expressed with respect to the channel widths of the respective transistors instead of their cross-sectional areas. In addition, since the channel resistance of transistor 30 corresponds to the resistance value for resistor 31, the channel resistance provided by each transistor 12(*i*) corresponds to $$R_{TR12(i)}=R_{31}[W_{TR30}/W_{TR12(i)}],$$

where "W" identifies the width of the channel of the respective transistor.

It will be appreciated that a single resistor control circuit 11 can connect to and control a number of transistors 12(*i*). A limitation on this number can follow from the facts that (i) the relationship between the channel resistance of resistors 12(*i*) and the resistance value of resistor 31 is directly related to the fact that the channel resistance of transistor 30 corresponds to the resistance value of resistor 31, and (ii) the correspondence between the channel resistance provided by transistor 30 and the resistance value of resistor 31 is based on the fact that the currents through legs 36 and 37 are the same. In particular, while it is the case that the direct-current impedance for a signal applied to the gate terminal of a MOSFET is very high, so that there is very little leakage of current applied to the gate terminal, there may be some leakage and if large numbers of transistors 12(*i*) are connected to line 13 the leakage may be significant, so that the second assumption will no longer be correct. In addition, increasing numbers of transistors 12(*i*) to line 13 will, in turn, cause an increase in the length of line 13, in which case it may pick up noise from proximately-placed but unrelated circuitry.

Figure 2:
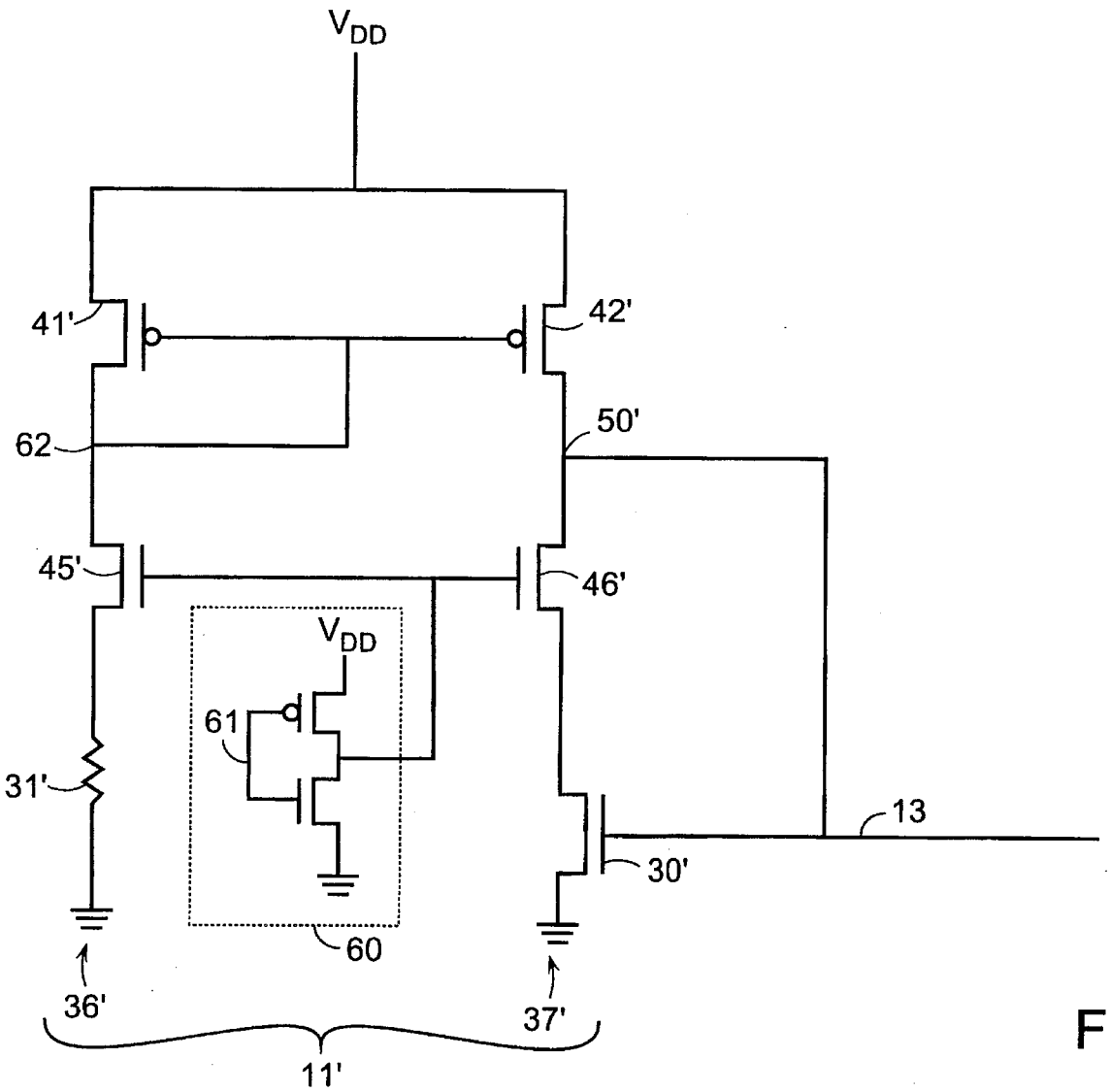
FIG. 2 is a schematic circuit diagram of a portion of a second resistor circuit constructed in accordance with the invention.

The resistance control circuit 11 of the resistor circuit 10 depicted in FIG. 1 requires two off-chip resistors 31 and 43, which, it will be appreciated, will require two off-chip pin connections. FIG. 2 depicts an alternate resistance control circuit 11' which requires only a single off-chip resistor 31, and thus only a single off-chip pin connection. Resistor control circuit 11' includes a resistance value control leg 36' [which also serves the function of current control leg 35 in resistance control circuit 11 (FIG. 1)] and a control signal output leg 37', which perform operations similar to those of legs 36 and 37 of the embodiment depicted in FIG. 1. Resistance value control leg 36', like leg 36 depicted in FIG. 1, includes a p-channel transistor 41', an n-channel transistor 45' and an off-chip resistor 31' connected in series between the power supply $V_{DD}$ and ground, and control signal output leg 37' includes p-channel transistor 42' and two n-channel transistors 46' and 30' connected between the power supply $V_{DD}$ and ground. In the resistance control circuit 11', the gate terminal 41(*g*)' and drain terminal 41(*d*)' of transistor 41' are both connected to a node 62, and thus the transistor 41' is in saturation. Since the gate terminal 42(*g*)' of transistor 42' is also connected to node 62, and since both transistors 41' and 42' have the same gate-to-source voltage difference, both will provide the same level of current, provided transistor 42' is maintained in saturation. In addition, a high-gain inverter 60 connected between a node 61, which connects the source terminal of transistor 45' and resistor 31', and the gate terminals of transistors 45' and 46', fixes the voltage on node 61 and therefore the current through resistor 31' and transistors 45' and 46'. With the circuit 11' so configured, the voltage on node 50', connecting transistors 42' and 46', is applied to line 13 to control the channel resistance of transistor 30' to have the same resistance value as resistor 31', and also to control the channel resistances of transistors 12(*i*) (shown in FIG. 1 ) as described above.

While the resistance control circuit 11' depicted in FIG. 2 does have the benefit that fewer off-chip circuit elements are required than would be used in circuit 11 (FIG. 1), the control of the operating characteristics of circuit 11' would likely be less precise. It will be appreciated, for example, that inverter 60 controls the transistor 45', which, in turn, controls the operating point of node 61 and thus transistor 41'. Since inverter 60 is wholly formed on the integrated circuit chip, it is subject to manufacturing process variations which may make precise control of the operation of the various elements of the resistance control circuit 11 difficult.

Figure 3:
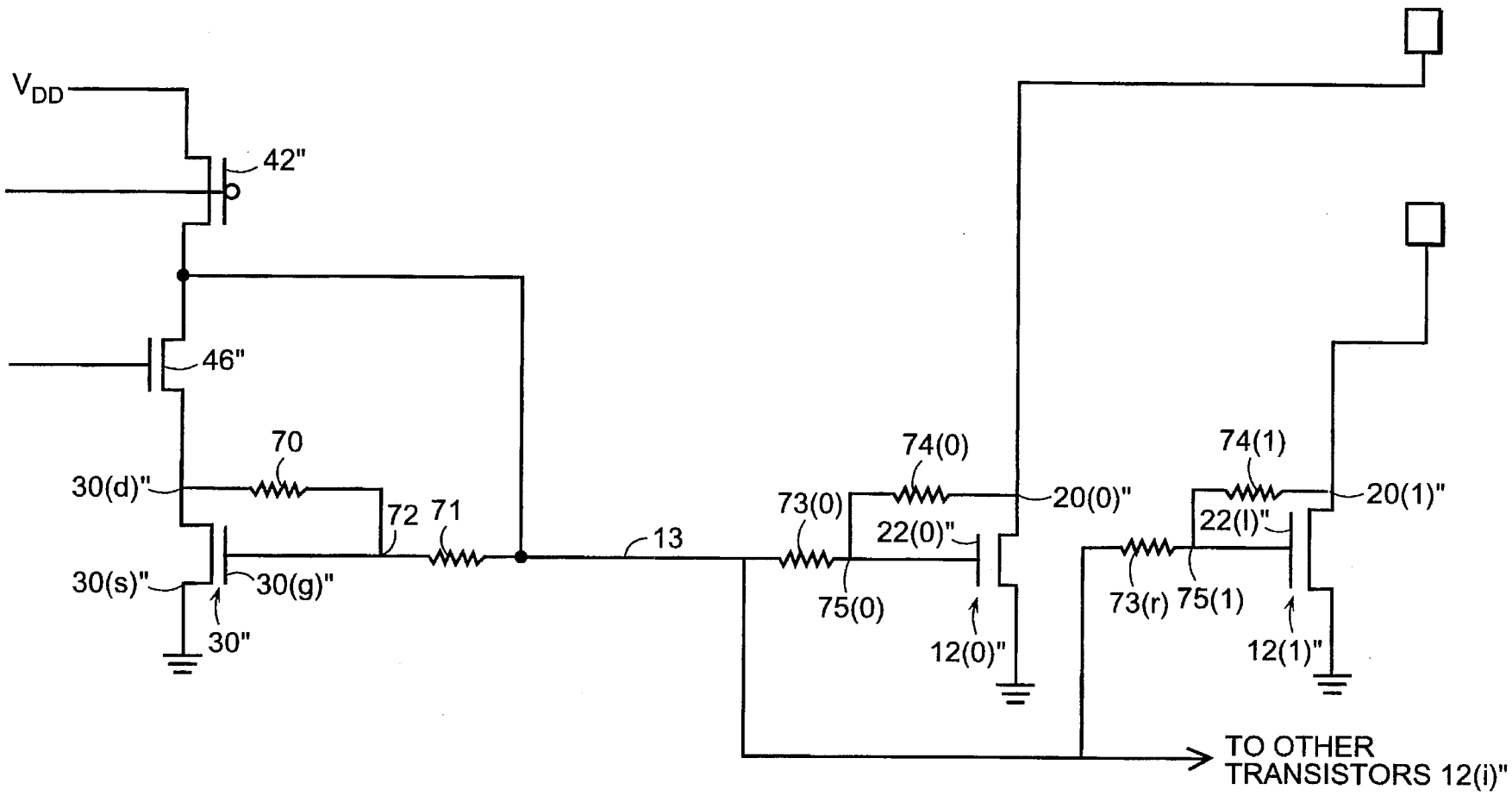
FIG. 3 is a schematic circuit diagram of a portion of a resistor circuit, showing a modification which may be used with the embodiments depicted in FIGS. 1 and 2.
Figure 4:
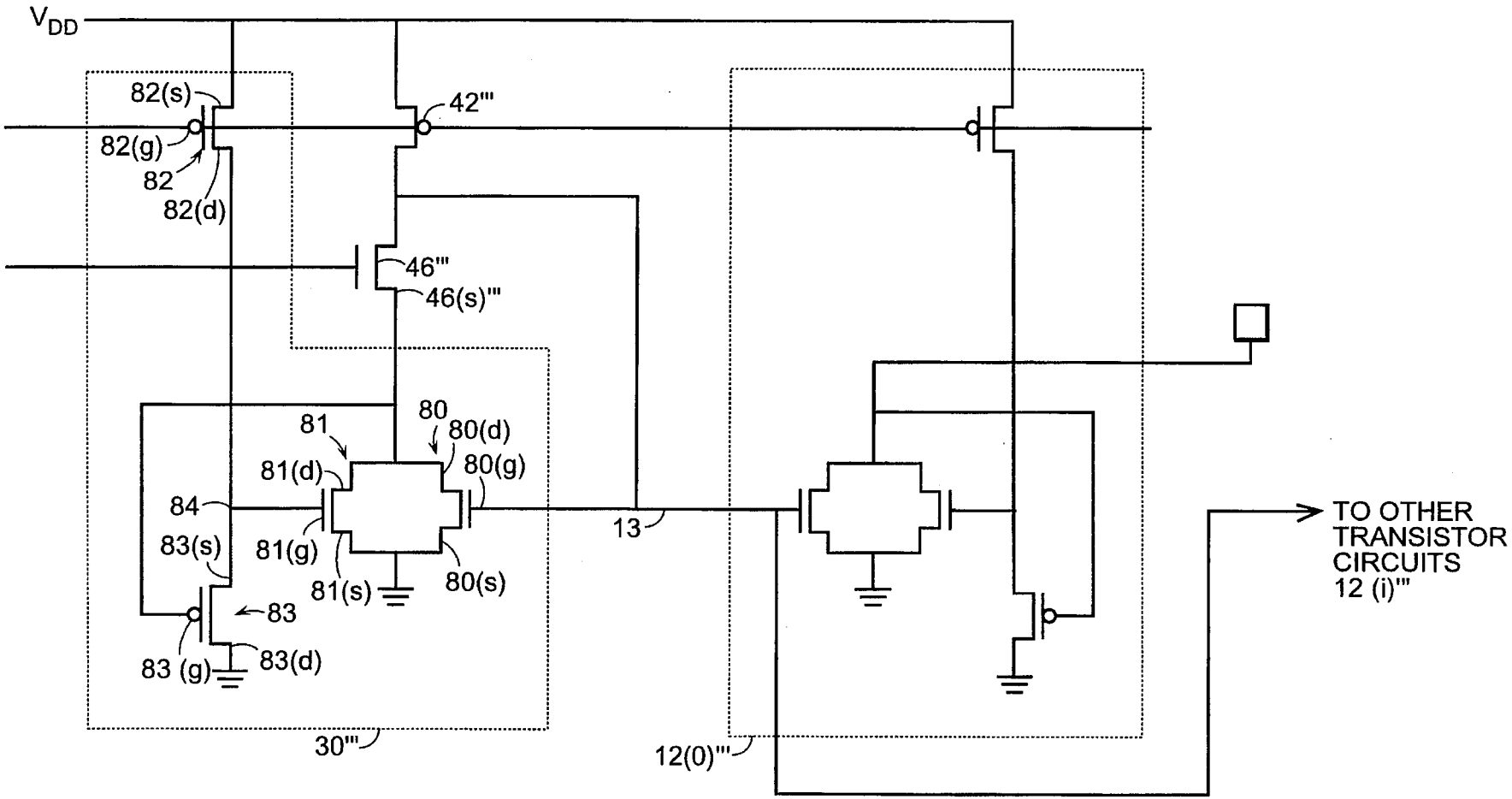
FIG. 4 is a schematic circuit diagram of a portion of a resistor circuit, showing another modification which may be used with the embodiments depicted in FIGS. 1 and 2.

Precise control of the channel resistances of the transistors 12(*i*), in relation to the resistance value of the external resistor 31 is based on the assumption that their channel resistances, along with the channel resistance of transistor 30, is not a function of the transistors' respective drain-to-source voltages. This assumption is not entirely accurate, and in fact, the channel conductance (the reciprocal of the channel resistance) of a transistor is more closely a linear function of the voltage difference between its gate and source terminals, minus the threshold voltage required to turn the transistor on, and further minus one-half of the voltage difference between its drain and source terminals, or $$g\propto(v_{gs}-v_{th})-\tfrac{1}{2}v_{ds}$$

where "g" represents the channel conductance, $v_{gs}$ represents the gate-to-source voltage, $v_{th}$ represents the threshold voltage, and $v_{ds}$ represents the drain-to-source voltage, and "∝" represents proportionality. (The threshold voltage $v_{th}$ is a constant for any particular transistor.) FIGS. 3 and 4 depict schematic circuit diagrams of a portion of the resistor circuit depicted in FIGS. 1 and 2, with modifications to make the drain-source voltage correction independent of the transistors' respective drain-to-source voltages.

With reference first to FIG. 3, that FIG. depicts a portion of a resistance control circuit such as shown in FIGS. 1 and 2, in particular transistors 42", 46" and 30", corresponding to transistors 42, 46 and 30 in FIG. and 42', 46' and 30' in FIG. 2, respectively. In addition, FIG. 3 depicts two transistors 12(0)" and 12(1)" [generally identified as transistors 12(*i*)"], which correspond to transistors 12(0) and 12(1) in FIG. 1. In FIG. 3, the line 13 is not connected directly to the gate terminals of the respective transistors 30" and 12(*i*)", but instead, for each transistor two resistors are connected in series between the line 13 and the transistor's drain terminal, with the node connecting the resistors being connected to control the transistor's gate terminal. In particular, the gate terminal 30(*g*)" of transistor 30" is connected to a node 72, which is connected to two resistors 70 and 71. Resistor 70 is connected between node 72 and the drain terminal 30(*d*)" of transistor 30", and resistor 71 is connected between line 13 and node 72. Similarly, each gate terminal 22(*i*)" of a transistor 12(*i*)" is connected to a node 75(*i*), which, in turn, is connected to two resistors 73(*i*) and 74(*i*). Each resistor 73(*i*) is, in turn, connected to line 13, and each resistor 74(*i*) is connected to the transistor's drain terminal 20(*i*)". Each resistor in the pair associated with each of the transistors 30" and 12(*i*)" has the same resistance value, although the particular resistance values provided for the resistors is not significant. In addition, resistors associated with different ones of the transistors may have different resistance values. The resistors used in the embodiment depicted in FIG. 3 may be formed from polysilicon material in a conventional manner.

Each pair of resistors associated with a transistor is provided to increase the voltage level at the transistor's gate terminal by an amount corresponding to one-half of the voltage difference between the transistor's drain terminal and its source terminal, or ½ $v_{ds}$, thereby to provide that the transistor's channel conductance will be solely a linear function of the voltage difference between its gate terminal and its source terminal. With respect initially to resistor pair 70 and 71 associated with transistor 30", those resistors form a voltage divider to effectively raise the voltage reference point for the voltage at node 72, and thus at the gate terminal 30(*g*)", by an amount corresponding to one-half the drain-to-gate voltage difference $v_{30''ds}$, so that the voltage level of node 72 corresponds to this amount plus the voltage on line 13, or $v_{13}+\frac{1}{2}v_{30''dg}$. The one-half factor follows from the fact that the two resistors 70 and 71 have the same resistance value, and the correction factor will differ if the resistors have different resistance ratios. Since, as noted above, the conductance $g_{30''}$ of transistor 30" is a function of $$g_{30''} \propto v_{30''gs} - v_{30''th} - \tfrac{1}{2} v_{30''ds}$$

(where $v_{30''th}$ is the threshold voltage for transistor 30). Since further the voltage $v_{30gs}$ applied to the transistor's gate terminal 30(*g*) at node 72 corresponds to one-half the voltage $v_{13}$ on line 13 plus one-half of the drain-to-source voltage difference $v_{30''ds}$ [that is, $\frac{1}{2}(v_{13}+v_{30''ds})$], the conductance of the channel of transistor 30" will be $$g_{30''} \propto \tfrac{1}{2}(v_{13}+v_{30''ds}) - v_{30''th} - \tfrac{1}{2} v_{30''ds} = \tfrac{1}{2} v_{13} - v_{30''th}$$

which is a function only of the voltage $v_{13}$ on line 13 (ignoring the threshold voltage for the transistor). Resistor pairs 73(*i*) and 74(*i*) associated with the other transistors 12(*i*)" provide similar corrections for their respective transistors.

FIG. 4, like FIG. 3, depicts a portion of a resistance control circuit such as shown in FIGS. 1 and 2, and accomplishes a similar result as that provided by FIG. 3, that is, it provides that the effective channel resistances provided by the transistors will be solely a function of the voltage applied to line 13, but it avoids the use of resistors used in the circuit depicted in FIG. 3. With reference to FIG. 4, that FIG. depicts a portion of a resistance control circuit such as shown in FIGS. 1 and 2, in particular transistors 42'" and 46'", corresponding to transistors 42 and 46 in FIG. 1 and 42' and 46' in FIG. 2, respectively. In addition, FIG. 4 depicts one transistor circuit 12(0)'", which generally corresponds to transistor 12(0) in FIG. 1. As in the embodiment depicted in FIG. 1, a plurality of transistor circuits [generally identified by reference numeral 12(*i*)'"] similar to transistor circuit 12(0)'" may be connected to line 13.

Transistor circuit 30'" includes two n-channel transistors 80 and 81 and two p-channel transistors 82 and 83. The transistors 80 and 81 are of equal size with their drain terminals 80(*d*) and 81(*d*) both connected to the source terminal of transistor 46'", and their source terminals 80(*s*) and 81(*s*) connected to ground. As a result, the channels of the transistors 80 and 81 are connected in parallel between the source terminal of transistor 46'" and ground. The p-channel transistor 82 serves as a current source, with the gate terminal 82(*g*) being controlled in parallel with the gate terminal of transistor 42'"; that is, for use in the embodiment depicted in FIG. 1, the gate terminal 82(*g*) of transistor 82 would be controlled by node 44 in the current control leg 35, whereas for use in the embodiment depicted in FIG. 2, the gate terminal 82(*g*) of transistor 82 would be controlled by the node 62 in the resistance value control leg 36'. In either case, the transistor 82, as with the transistor 42'", is maintained in saturation. The gate terminal 83(*g*) of transistor 83 is controlled by the voltage at the drain terminals 80(*d*) and 81(*d*) of transistors 80 and 81, and thus provides an output at node 84 which is a function of the drain-to-source voltage of transistors 80 and 81.

Since the channels of transistors 80 and 81 are connected in parallel, they will together provide a total conductance value which corresponds to the sum of their individual conductance values. It is desired that this total conductance value will correspond to the conductance value of the off-chip resistor 31, which corresponds to the reciprocal of the resistor's resistance value. As noted above, the conductance of the channel of transistor 80 is a function of the voltage applied to line 13, which corresponds to the voltage difference between the gate terminal 80(*g*) and the source terminal 80(*s*) of transistor 80, minus the threshold voltage required to turn the transistor on, minus one-half the voltage difference between the drain terminal 80(*d*) and the source terminal 80(*s*). Otherwise stated, the conductance $g_{80}$ of transistor 80 correponds to $$g_{80} \propto v_{13} - v_{80th} - \tfrac{1}{2} v_{80ds}$$

where $v_{13}$ is the voltage applied to line 13, $v_{80th}$ is the threshold voltage for transistor 80, $v_{ds}$ is the drain-to-source voltage for transistor 80 and "∝" indicates proportionality.

The conductance of the channel of transistor 81 is controlled by a node 84 connecting transistors 82 and 83, with transistor 83 being controlled by the voltage difference between the drain terminal 81(*d*) and the source terminal 81(*s*), since the source terminal 81(*s*) is at the ground voltage level. Since transistor 82 is in saturation, transistor 83 controls the voltage at node 84 to be equal to a constant offset voltage $v_{83k}$ plus the drain-to-source voltage $v_{81ds}$ of transistor 81. Since the voltage at node 84 with respect to ground corresponds to the gate-to-source voltage $v_{81gs}$ of transistor 81, $$v_{81gs} = v_{81ds} + v_{83k}.$$

The conductance $g_{81}$ of transistor 81, like that of any MOSFET operating in its linear region, is proportional to its gate-to-source voltage $v_{81gs}$, minus the threshold voltage $v_{81th}$, and minus one-half its drain-to-source voltage $v_{81ds}$. However, since the gate-to-source voltage $v_{81gs}$ of transistor 81 is constrained by transistor 83 to be equal to its (that is, transistor 81's) drain-to-source voltage $v_{81ds}$ plus the offset voltage $v_{83k}$, the conductance $g_{81}$ of transistor 81 will be proportional to $$g_{81} \propto v_{81gs} - v_{81th} - \tfrac{1}{2} v_{81ds} = (v_{81ds} + v_{83k}) - v_{81th} - \tfrac{1}{2} v_{81ds} = \tfrac{1}{2} v_{81ds} + v_{83k} - v_{81th}$$

Since the drain and source terminals of the transistors 80 and 81 are connected in together, the total conductance $g_t$ between their drain and source terminals is the sum of $g_{80}$ and $g_{81}$, or $$g_t = g_{80} + g_{81} \propto v_{13} - v_{80th} - \tfrac{1}{2} v_{80ds} + \tfrac{1}{2} v_{81ds} + v_{83k} - v_{81th}$$

Also since the drain and source terminals of transistors 80 and 81 are connected together, $v_{80ds} = v_{81ds}$, and so the total conductance $g_t$ corresponds to $$g_t = v_{13} + v_{83k} - v_{80th} - v_{81th}$$

which is independent of the drain-to-source voltage level for either transistor 80 or transistor 81. Accordingly, the total channel resistance provided by transistors 80 and 81 will be a function only of the voltage level $v_{13}$ on line 13. It should be noted that the constant offset voltage $v_{83k}$ provided by transistor 83 at node 84 should be greater than $v_{81th}$ to ensure that transistor 81 operates in its linear range.

Transistor circuits 12(*i*)''' are constructed similarly to transistor circuit 30''', and operate in a similar manner. Accordingly, the resistance provided by transistor circuits 12(*i*)''' will also be a function only of the voltage level $v_{13}$ on line 13, and will be insensitive to drain-to-source voltage differences.

The resistor circuits described above in connection with FIGS. 1 through 4 provide a number of advantages. In particular, they provide for accurate resistors of predetermined resistance values for use on an integrated circuit chip, using only one or at most two off-chip transistors, with the resistance values being controlled by a single off-chip resistor and ratios of geometries of various components comprising the circuits. Since a small number of off-chip circuit elements are needed, the number of off-chip connections can be minimized, which can be importance in current integrated circuit chip designs which typically require large numbers of off-chip connections for signals to be processed by the chip.

While the circuits depicted on FIGS. 1 through 4 have been described as having certain transistors which have n-channels and others as having p-channels, it will be appreciated by those skilled in the art that the channel characteristics of the transistors may be reversed.

The foregoing description has been limited to a specific embodiment of this invention. It will be apparent, however, that various variations and modifications may be made to the invention, with the attainment of some or all of the advantages of the invention. It is the object of the appended claims to cover these and such other variations and modifications as come within the true spirit and scope of the invention.

What is claimed as new and desired to be secured by Letters Patent of the United States is:

1. A resistor circuit including:

A. a resistance control circuit comprising:

i. a control signal output element including a first current source, a first controllable transistor and a reference transistor connected serially between said power source and a reference voltage level, for generating a resistance control signal in response to an internal control signal to maintain the reference transistor at a selected resistance value;

ii. a reference value control element including a second current source, a second controllable transistor and a reference resistor connected serially between said power source and said reference voltage level, for generating said internal control signal for controlling the resistance value of the reference transistor in relation to the resistance value provided by the reference resistor;

both said first and second current sources sourcing a predetermined amount of current, said first and second controllable transistors being controlled in tandem in relation to the reference resistor resistance value, the second controllable transistor in turn generating said internal control signal to control the resistance value of the reference transistor, and B. at least one insulated gate field effect transistor controlled by the resistance control signal to provide a resistance value which is a function of the resistance value of the reference transistor and ratios of selected physical characteristics of the reference transistor.

2. A resistor circuit as defined in claim 1 in which said resistance value control element further includes a sourced current control element for controlling the amount of current sourced by said first and second current sources.

3. A resistor circuit as defined in claim 2 in which the sourced current control element comprises a saturated transistor, the sourced current control element's saturated transistor controlling transistors included in the first and second current sources to be saturated.

4. A resistor circuit as defined in claim 1 further comprising a first and second transistor control element for controlling the first and second controllable transistors in relation to the voltage level at a connection between the first controllable transistor and the reference resistor.

5. A resistor circuit as defined in claim 4 in which the first and second transistor control element comprises an inverter.

* * * * *